US010184703B2

(12) United States Patent
Saito et al.

(10) Patent No.: US 10,184,703 B2
(45) Date of Patent: Jan. 22, 2019

(54) MULTIPASS MICROCHANNEL HEAT EXCHANGER

(71) Applicant: Carrier Corporation, Farmington, CT (US)

(72) Inventors: Kazuo Saito, Jamesville, NY (US); Michael F. Taras, Fayetteville, NY (US)

(73) Assignee: CARRIER CORPORATION, Farmington, CT (US)

( * ) Notice: Subject to any disclaimer, the term of this patent is extended or adjusted under 35 U.S.C. 154(b) by 1 day.

(21) Appl. No.: 14/829,151

(22) Filed: Aug. 18, 2015

(65) Prior Publication Data

US 2016/0054077 A1 Feb. 25, 2016

Related U.S. Application Data

(60) Provisional application No. 62/039,161, filed on Aug. 19, 2014.

(51) Int. Cl.
*F25B 39/00* (2006.01)
*F28F 9/02* (2006.01)
(Continued)

(52) U.S. Cl.
CPC ..... *F25B 39/00* (2013.01); *F28D 1/05391* (2013.01); *F28F 9/027* (2013.01); *F28F 9/0209* (2013.01); *F28F 27/02* (2013.01); *F25B 41/04* (2013.01); *F25B 2400/0403* (2013.01); *F25B 2400/0409* (2013.01); *F25B 2400/23* (2013.01);
(Continued)

(58) Field of Classification Search
CPC .. F25B 2400/23; F25B 2500/18; F25B 41/04; F25B 39/04; F25B 43/006; F25B 2313/001; F28F 2250/06; F28D 1/05325; F28D 1/05375
See application file for complete search history.

(56) References Cited

U.S. PATENT DOCUMENTS 4,282,927 A 8/1981 Simmons
5,826,649 A 10/1998 Chapp et al.
(Continued)

FOREIGN PATENT DOCUMENTS

EP 1410929 A2 * 4/2004 ..... B60H 1/00328
JP 2013015289 A * 1/2013 ..... F28D 1/05391

OTHER PUBLICATIONS

Zou, Yang, "Refrigerant flow distribution in vertical headers of reversible microchannel heat exchangers," Dissertation, University of Illinois at Urbana-Champaign, May 30, 2014, pp. 1-210.

*Primary Examiner* — Frantz Jules
*Assistant Examiner* — Lionel Nouketcha
(74) *Attorney, Agent, or Firm* — Cantor Colburn LLP

(57) ABSTRACT

A heat exchanger is provided including a first manifold, a second manifold, and a plurality of heat exchange tubes arranged in spaced parallel relationship and fluidly coupled to the first manifold and the second manifold. At least one divider plate is arranged within the first manifold such that the first manifold has a fluidly distinct first chamber and second chamber and the heat exchanger has a multi-pass flow configuration. The first chamber is configured to receive at least a partially liquid refrigerant and has a length between about 20% and about 60% a length of the first manifold.

7 Claims, 18 Drawing Sheets

(51) Int. Cl.

| | |
|---|---|
| ***F28F 27/02*** | (2006.01) |
| *F28D 1/053* | (2006.01) |
| *F28D 21/00* | (2006.01) |
| *F28D 1/02* | (2006.01) |
| *F25B 41/04* | (2006.01) |

(52) U.S. Cl.
CPC ..... *F25B 2500/18* (2013.01); *F28D 1/05325* (2013.01); *F28D 1/05375* (2013.01); *F28D 2001/0273* (2013.01); *F28D 2021/0068* (2013.01); *F28F 2250/06* (2013.01)

(56) References Cited

U.S. PATENT DOCUMENTS 5,987,907 A * 11/1999 Morimoto ..... F25B 9/006 62/212
6,652,627 B1 * 11/2003 Tonkovich ..... B01D 53/0423 95/104
6,971,246 B2 * 12/2005 Kurata ..... B60H 1/00328 62/196.4
6,981,390 B2 * 1/2006 Yamada ..... F25B 39/04 62/117
7,044,200 B2 5/2006 Gupte et al.
7,484,555 B2 2/2009 Beamer et al.
7,527,089 B2 5/2009 Gorbounov et al.
7,967,060 B2 6/2011 Trumbower et al.
8,113,270 B2 * 2/2012 Rios ..... F25B 41/067 165/174
8,225,853 B2 7/2012 Macri et al.
8,235,101 B2 8/2012 Taras et al.
8,662,148 B2 3/2014 Wand
8,695,375 B2 4/2014 Kirkwood
2002/0023448 A1 * 2/2002 Ito ..... B60H 1/3227 62/222
2008/0104975 A1 * 5/2008 Gorbounov ..... F25B 41/043 62/117
2009/0040314 A1 2/2009 Chan et al.
2010/0089095 A1 * 4/2010 Macri ..... F25B 39/028 62/525
2010/0089559 A1 4/2010 Gorbounov et al.
2010/0206535 A1 * 8/2010 Munoz ..... F25B 39/028 165/173
2010/0242535 A1 9/2010 Jianlong et al.
2011/0017438 A1 1/2011 Huazhao et al.
2011/0073277 A1 * 3/2011 Karl ..... F24F 13/30 165/67
2012/0011867 A1 * 1/2012 Koons ..... F25B 39/04 62/115

* cited by examiner

MULTIPASS MICROCHANNEL HEAT EXCHANGER

CROSS-REFERENCE TO RELATED APPLICATIONS

This application claims the benefit of U.S. provisional patent application Ser. No. 62/039,161 filed Aug. 19, 2014, the entire contents of which are incorporated herein by reference.

BACKGROUND

This invention relates generally to heat exchangers and, more particularly, to microchannel heat exchanger for use in heat pump applications.

One type of refrigerant system is a heat pump. A heat pump can be utilized to heat air being delivered into an environment to be conditioned, or to cool and typically dehumidify the air delivered into the indoor environment. In a basic heat pump, a compressor compresses a refrigerant and delivers it downstream through a refrigerant flow reversing device, typically a four-way reversing valve. The refrigerant flow reversing device initially routes the refrigerant to an outdoor heat exchanger, if the heat pump is operating in a cooling mode, or to an indoor heat exchanger, if the heat pump is operating in a heating mode. From the outdoor heat exchanger, the refrigerant passes through an expansion device, and then to the indoor heat exchanger, in the cooling mode of operation. In the heating mode of operation, the refrigerant passes from the indoor heat exchanger to the expansion device and then to the outdoor heat exchanger. In either case, the refrigerant is routed through the refrigerant flow reversing device back into the compressor. The heat pump may utilize a single bi-directional expansion device or two separate expansion devices.

In recent years, much interest and design effort has been focused on the efficient operation of the heat exchangers (indoor and outdoor) in heat pumps. High effectiveness of the refrigerant system heat exchangers directly translates into the augmented system efficiency and reduced life-time cost. One relatively recent advancement in heat exchanger technology is the development and application of parallel flow, micro-channel or mini-channel heat exchangers, as the indoor and outdoor heat exchangers.

These parallel flow heat exchangers are provided with a plurality of parallel heat transfer tubes, typically of a non-round shape, among which refrigerant is distributed and flown in a parallel manner. The heat exchanger tubes typically incorporate multiple channels and are oriented substantially perpendicular to a refrigerant flow direction in the inlet and outlet manifolds that are in communication with the heat transfer tubes. Heat transfer enhancing fins are typically disposed between and rigidly attached to the heat exchanger tubes. The primary reasons for the employment of the parallel flow heat exchangers, which usually have aluminum furnace-brazed construction, are related to their superior performance, high degree of compactness, structural rigidity, and enhanced resistance to corrosion.

The growing use of low global warming potential refrigerants introduces another challenge related to refrigerant charge reduction. Current legislation limits the amount of charge of refrigerant systems, and heat exchangers in particular, containing most low global warming potential refrigerants (currently classified as A2L substances). Microchannel heat exchangers have a small internal volume and therefore store less refrigerant charge than conventional round tube plate fin heat exchangers. Although a lower refrigerant charge is generally beneficial, the smaller internal volume of microchannel heat exchangers makes them extremely sensitive to overcharge situations, which could result in refrigerant charge imbalance, degrade refrigerant system performance, and cause nuisance shutdowns. In addition, the refrigerant charge contained in the manifolds of the microchannel heat exchanger, particularly when the heat exchanger operates as a condenser, is significant, such as about half of the total heat exchanger charge. As a result, the refrigerant charge reduction potential of the heat exchanger is limited.

SUMMARY

According to one embodiment, a heat exchanger is provided including a first manifold, a second manifold, and a plurality of heat exchange tubes arranged in spaced parallel relationship and fluidly coupled to the first manifold and the second manifold. At least one divider plate is arranged within the first manifold such that the first manifold has a fluidly distinct first chamber and second chamber and the heat exchanger has a multipass flow configuration. The first chamber is configured to receive at least a partially liquid refrigerant and has a length between about 20% and about 60% a length of the first manifold.

According to one embodiment, a heat exchanger is provided including a first manifold, a second manifold, and a plurality of heat exchange tubes arranged in spaced parallel relationship and fluidly coupled to the first manifold and the second manifold. At least one divider plate is arranged within the first manifold such that the first manifold has a fluidly distinct first chamber and second chamber and the heat exchanger has a flow configuration including at least a first pass and a second pass. A separator configured to separate a liquid and vapor refrigerant is arranged between the first pass and the second pass, and at least one bypass conduit extends from the separator and is configured to bypass one of the first pass and second pass of the heat exchanger.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
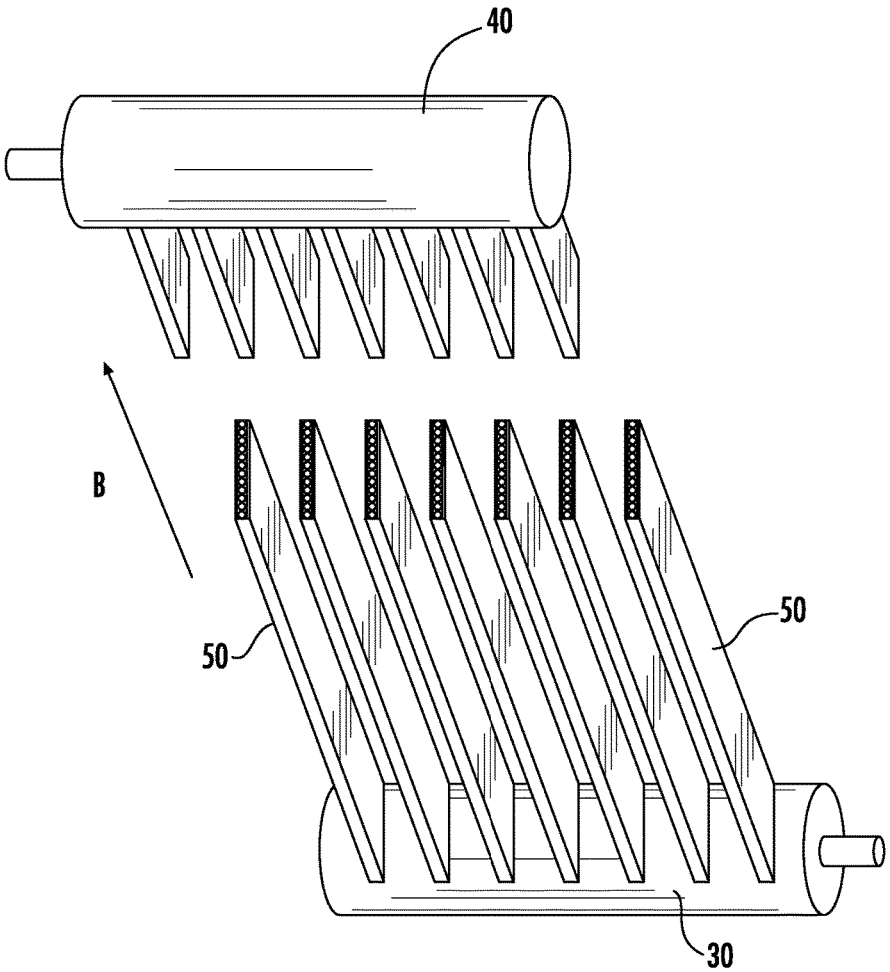
FIG. 1 is a perspective view of a known microchannel heat exchanger having a single pass flow configuration.

Referring now to FIG. 1, an example of a known multichannel heat exchanger is illustrated. The heat exchanger includes a first manifold or header 30, a second manifold or header 40 spaced apart from the first manifold 30, and a plurality of heat exchange tubes 50 extending in a spaced parallel relationship between and fluidly connecting the first manifold 30 and the second manifold 40. In the illustrated, non-limiting embodiments, the first header 30 and the second header 40 are oriented generally horizontally and the heat exchange tubes 50 extend generally vertically between the two headers 30, 40. By arranging the tubes 50 vertically, water condensate collected on the tubes 50 is more easily drained from the heat exchanger 30. In the non-limiting embodiments illustrated in FIGS. 1-3, the headers 30, 40 comprise hollow, closed end cylinders having a circular cross-section. However, headers 30, 40 having other configurations, such as a semi-elliptical, square, rectangular, hexagonal, octagonal, or other cross-sections for example, are within the scope of the present disclosure. The heat exchanger 20 may be used as either a condenser or an evaporator in a vapor compression system, such as a heat pump for example.

Figure 2:
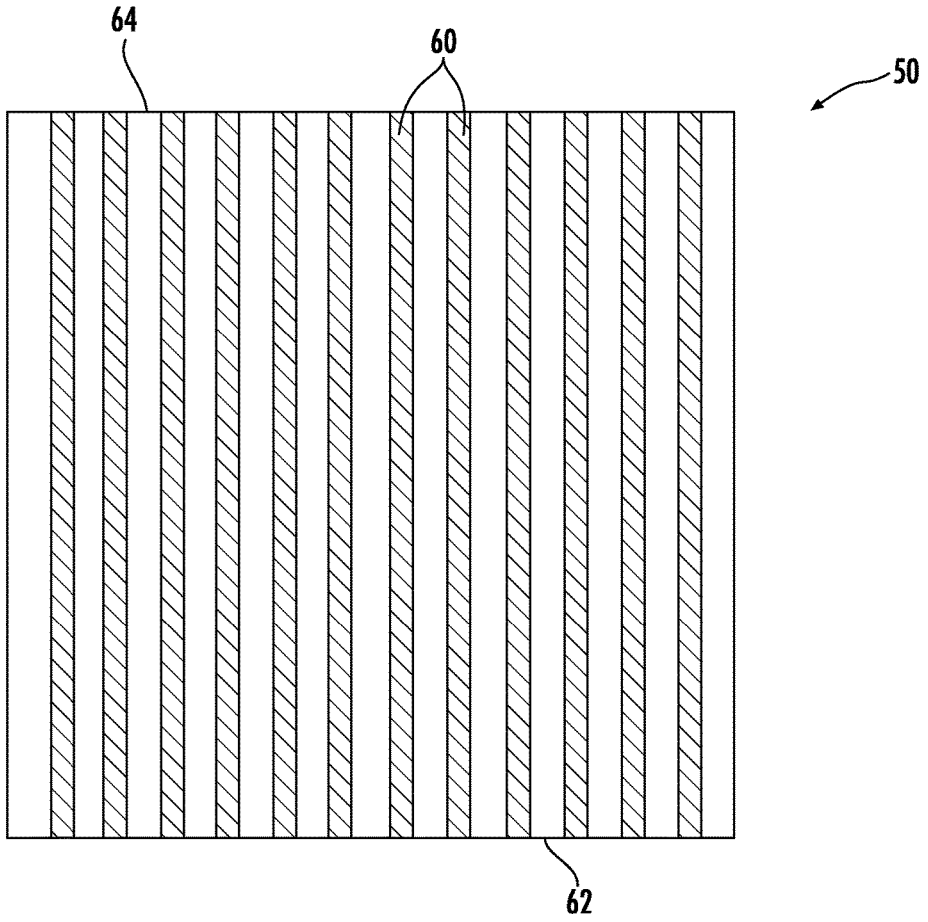
FIG. 2 is a cross-sectional view of a microchannel heat exchanger tube of the microchannel heat exchanger of FIG. 1.
Figure 3:
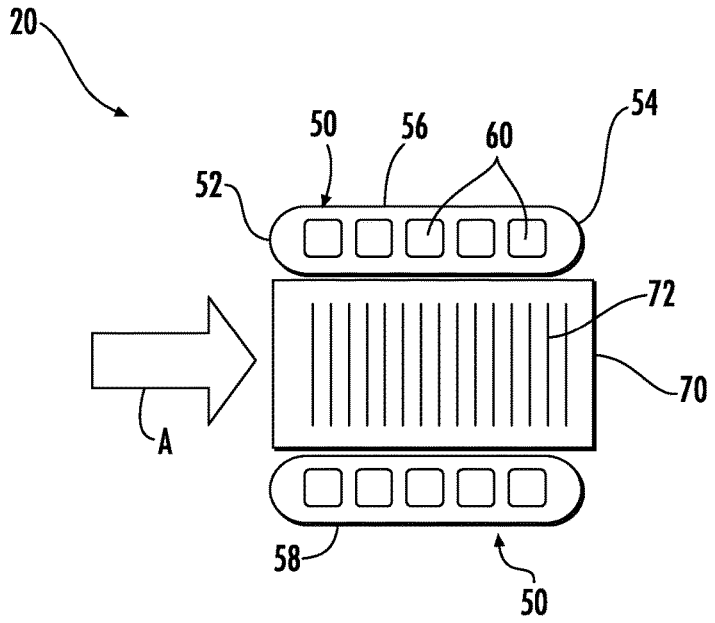
FIG. 3 a top cross-sectional view of the microchannel heat exchanger of FIG. 1.
Figure 4:
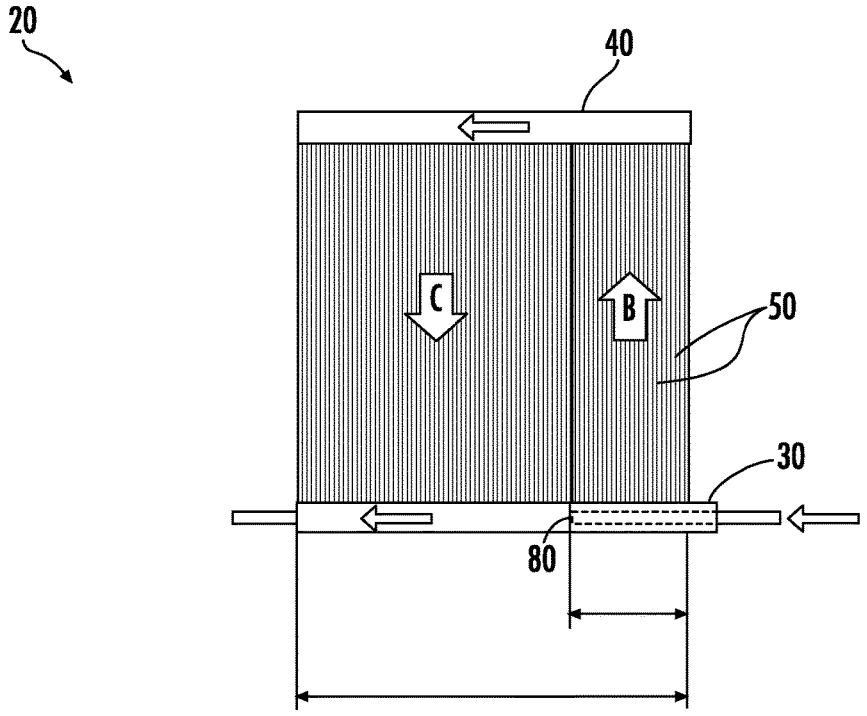
FIG. 4 is a cross-sectional view of a multi-pass microchannel heat exchanger according to an embodiment of the present disclosure.

Referring now to FIGS. 2 and 3, each heat exchange tube 50 comprises a flattened heat exchange tube having a leading edge 52, a trailing edge 54, a first surface 56, and a second surface 58. The leading edge 52 of each heat exchanger tube 50 is upstream of its respective trailing edge 52 with respect to an airflow A through the heat exchanger 20. The interior flow passage of each heat exchange tube 50 may be divided by interior walls into a plurality of discrete flow channels 60 that extend over the length of the tubes 50 from an inlet end 62 to an outlet end 64 and establish fluid communication between the respective first and second manifolds 30, 40. The flow channels 60 may have a circular cross-section, a rectangular cross-section, a trapezoidal cross-section, a triangular cross-section, or another non-circular cross-section. The heat exchange tubes 50 including the discrete flow channels 60 may be formed using known techniques and materials, including, but not limited to, extruded or folded.

As known, a plurality of heat transfer fins 70 may be disposed between and rigidly attached, usually by a furnace braze process, to the heat exchange tubes 50, in order to enhance external heat transfer and provide structural rigidity to the heat exchanger 20. Each folded fin 70 is formed from a plurality of connected strips or a single continuous strip of fin material tightly folded in a ribbon-like serpentine fashion thereby providing a plurality of closely spaced fins 72 that extend generally orthogonal to the flattened heat exchange tubes 50. Heat exchange between the fluid within the heat exchanger tubes 50 and air flow A, occurs through the outside surfaces 56, 58 of the heat exchange tubes 50 collectively forming the primary heat exchange surface, and also through the heat exchange surface of the fins 72 of the folded fin 70, which form the secondary heat exchange surface.

Referring again to FIG. 1, the illustrated heat exchanger 20 has a single-pass flow configuration. For example, refrigerant is configured to flow from the first header 30 to the second header through the plurality of heat exchanger tubes 50 in the direction indicated by arrow B.

With reference now to FIGS. 4-17, various embodiments of a multi-channel, heat exchanger 20 having a multi-pass configuration are illustrated. To form a multi-pass flow configuration, at least one of the first manifold 30 and the second manifold 40 includes two or more fluidly distinct chambers. In one embodiment, the fluidly distinct chambers are formed by separate manifolds coupled together to form the first or second manifold 30, 40. Alternatively, a baffle or divider plate 80 known to a person of ordinary skill in the art may be arranged within at least one of the first header 30 and the second header 40 to define a plurality of fluidly distinct chambers therein. For example, with the addition of a divider plate 80 in the first header 30, a two-pass flow configuration is formed. Fluid may flow from the first chamber 32 of the first manifold 30 to the second manifold 40, in the direction indicated by arrow B, through a first group 50*a* of heat exchange tubes 50 and back to a second chamber 34 of the first manifold 30, in the direction indicated by arrow C, through a second group 50*b* of heat exchange tubes 50. Alternatively, the fluid may be configured to flow through the heat exchanger 20 in a reverse direction. The first group 50*a* of heat exchange tubes 50 and the second group 50*b* of heat exchanger tubes 50 may be substantially similar, or may vary in size and shape. In addition, the number of heat exchange tubes 50 within the first group 50*a* and the second group 50*b* may be the same or different.

Regardless of the direction of flow of the refrigerant through the heat exchanger 20, the first chamber 32 of the first manifold 30 is configured to receive at least a partially liquid refrigerant and the second chamber 34 of the first manifold 30 is configured to receive a vapor refrigerant. In heat exchangers 20 having a two-pass flow configuration, the divider plate 80 is positioned within the first header 30 such that the length of the first chamber 32 configured to receive at least a partially liquid refrigerant is between about 20% and about 60%, and more specifically between about 30% and about 50%, of the length of the first header 30.

Figure 5A:
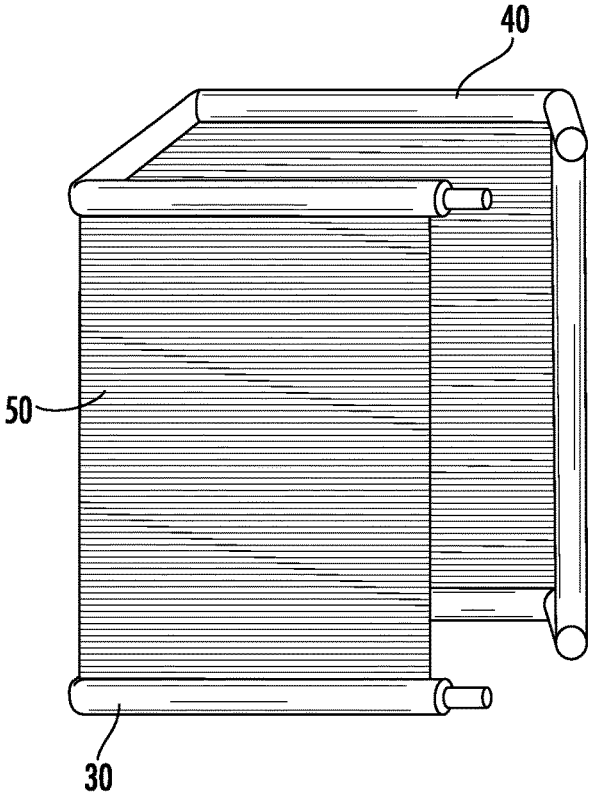
FIGS. 5*a*-5*c* are various view of a multi-pass microchannel heat exchanger according to an embodiment of the present disclosure.
Figure 5B:
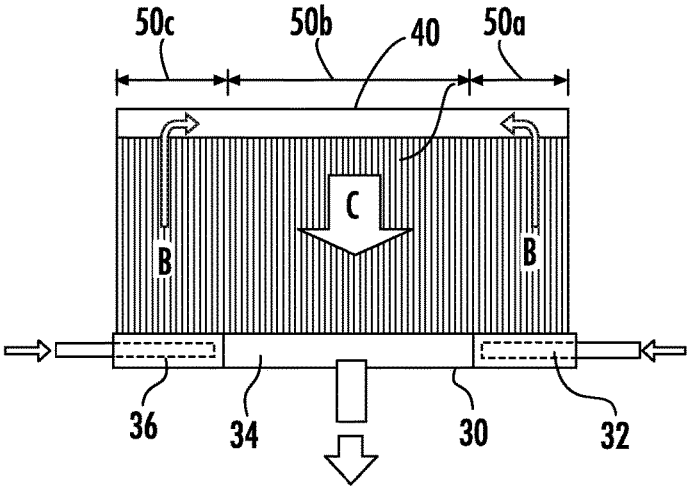
Figure 5C:
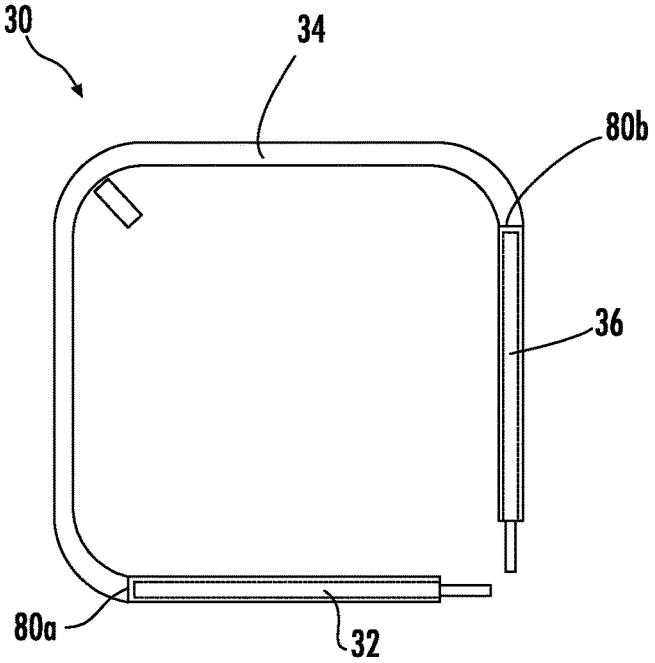

Another embodiment of a two-pass multi-channel heat exchanger 20 is illustrated in FIGS. 5*a*-5*c*. In the illustrated, non-limiting embodiment, the first header 30 and the second header 40 are bent to form a generally rectangular or C-shape. Arranged within the first header 30 is a first divider plate 80*a* and a second divider plate 80*b* configured to divide the first header 30 into a first chamber 32, a second chamber 34, and a third chamber 36. In the illustrated, non-limiting embodiment, the first chamber 32 and the third chamber 36 of the first manifold 30 are configured to receive at least a partially liquid refrigerant, and the second chamber 34 of the first manifold 30 is configured to receive a vapor refrigerant. In one embodiment, a length of the first chamber 32 and the third chamber 36 are substantially identical and have the same number of heat exchanger tubes 50 coupled thereto.

A first group 50*a* of one or more heat exchanger tubes 50 extends between and fluidly couples the first chamber 32 and the intermediate second header 40. A second group 50*b* of at least one heat exchanger tube 50 extends between and fluidly couples the second intermediate header 40 and the second chamber 34 of the first header 30, A third group 50*c* of one or more heat exchanger tubes 50 extends between and fluidly couples the third chamber 36 of the first header 30 and the second intermediate header 40.

During operation of the two-pass heat exchanger 20 illustrated in FIGS. 5*a*-5*c* as an evaporator, two-phase refrigerant mixture is provided into the first chamber 32 and the third chamber 36 of the first header 30 (FIG. 2*b*). The refrigerant flows through the first group of heat exchanger tubes 50*a* and the third group of heat exchanger tubes 50*c*, respectively, to the intermediate second header 40. From the second header 40, the refrigerant flows through the second group 50*b* of heat exchanger tubes 50 to the second chamber 34 of the first header 30 and to an outlet formed therein. As the refrigerant flows sequentially through the first and second group 50*a*, 50*b* of heat exchanger tubes 50, or alternatively, through the third and second group 50*c*, 50*b* of heat exchanger tubes 50, heat from the refrigerant is transferred to the adjacent flow of air A. As a result, a substantially vaporized refrigerant is provided at an outlet formed in the second chamber 34 of the first header 30. In another embodiment, refrigerant is configured to flow in a reverse direction through the heat exchanger 20 when operated as a condenser.

Referring now to FIG. 3, an embodiment of a heat exchanger 20 having a three-pass flow configuration is illustrated. In the embodiment of FIG. 3, the first header 30 includes a first divider plate 80 configured to form a fluidly distinct first and second chamber 32, 34 respectively. The second header 40 also includes a divider plate 80 configured to divide the second header 40 into a first chamber 42 and a second chamber 44. In the illustrated, non-limiting embodiment, the first chamber 32 of the first header 30 is configured to receive at least a partially refrigerant liquid and the second chamber 44 of the second header 40 is configured to receive a vapor refrigerant. The second chamber 34 of the first header 30 and the first chamber 42 of the second header 40 are therefore configured as intermediate headers within the refrigerant flow path. In embodiments of the heat exchanger 20 having a three-pass configuration, the divider plate 80 is positioned within the first header 30 such that the length of the first chamber 32 is between about 20% and about 60%, and more specifically between about 30% and about 50%, of the length of the first header 30.

A first group 50*a* of one or more heat exchanger tubes 50 extends between and fluidly couples the first chamber 32 of the first header 30 and the intermediate chamber 42 of the second header 40. A second group 50*b* of at least one heat exchanger tube 50 extends between and fluidly couples the first chamber 42 of the second header 40 and the second chamber 34 of the first header 30. A third group 50*c* of one or more heat exchanger tubes 50 extends between and fluidly couples the second chamber 34 of the first header 30 and the second chamber 44 of the second header 40.

In embodiments where the three-pass heat exchanger of FIG. 3 is configured to operate as an evaporator, a two-phase mixture of refrigerant liquid and vapor is provided to the first or liquid chamber 32 of the first header 30. From the first chamber 32 of the first header 30, the refrigerant flows to the first chamber 42 of the second header 40 through the first group 50*a* of heat exchanger tubes 50, in the direction indicated by arrow B. The refrigerant then flows from the first chamber 42 of the second header 40 to the second chamber 34 of the first header 30 through the second group 50*b* of heat exchanger tubes 50, in the direction indicated by arrow C, and from the second chamber 34 of the first header 30 to the second chamber 44 of the second header 40 through the third group 50*c* of heat exchanger tubes 50, in a direction indicated by arrow D. As the refrigerant flows sequentially through the first, second, and third groups 50*a*, 50*b*, 50*c* of heat exchanger tubes 50, heat from air A passing there over is transferred to the refrigerant. As a result, substantially vaporized refrigerant is supplied at an outlet formed in the second chamber 44 of the second header 40. As previously suggested, the direction of refrigerant flow through the heat exchanger 20 may be reversed, such as when the heat exchanger is configured as a condenser for example.

Figure 8:
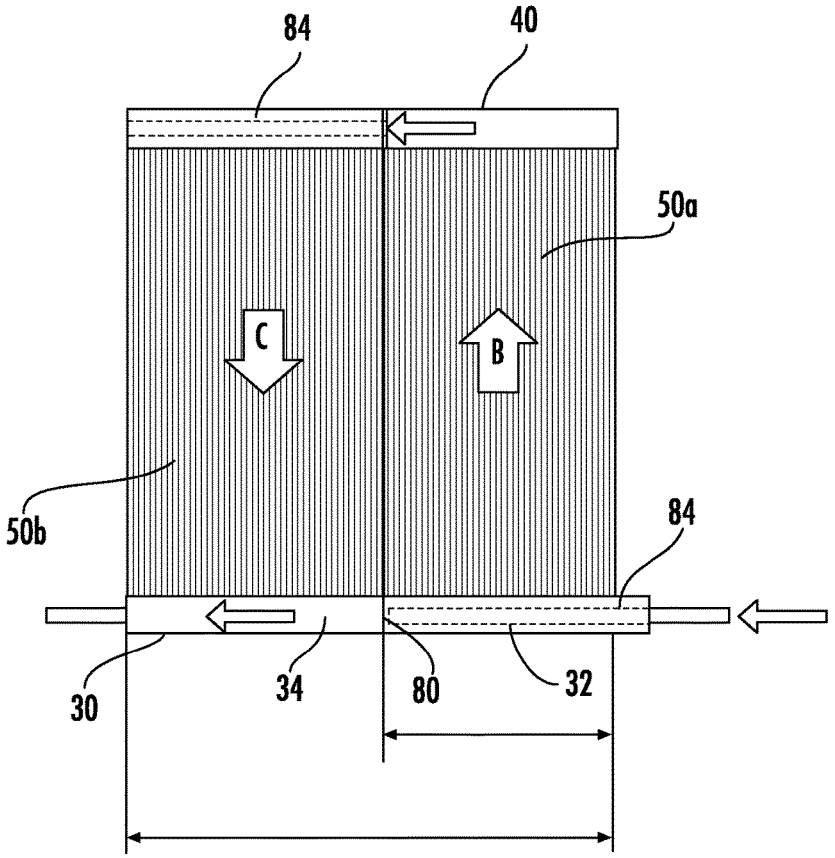
FIG. 8 is a cross-sectional view of a multi-pass microchannel heat exchanger according to an embodiment of the present disclosure.
Figure 9:
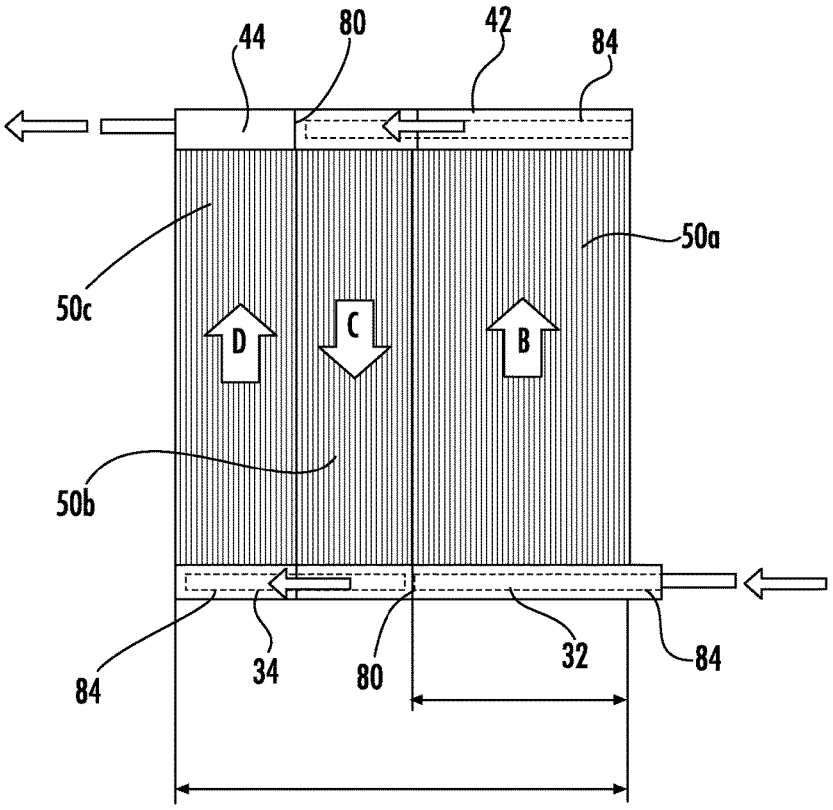
FIG. 9 is a cross-sectional view of a multi-pass microchannel heat exchanger according to an embodiment of the present disclosure.
Figure 10:
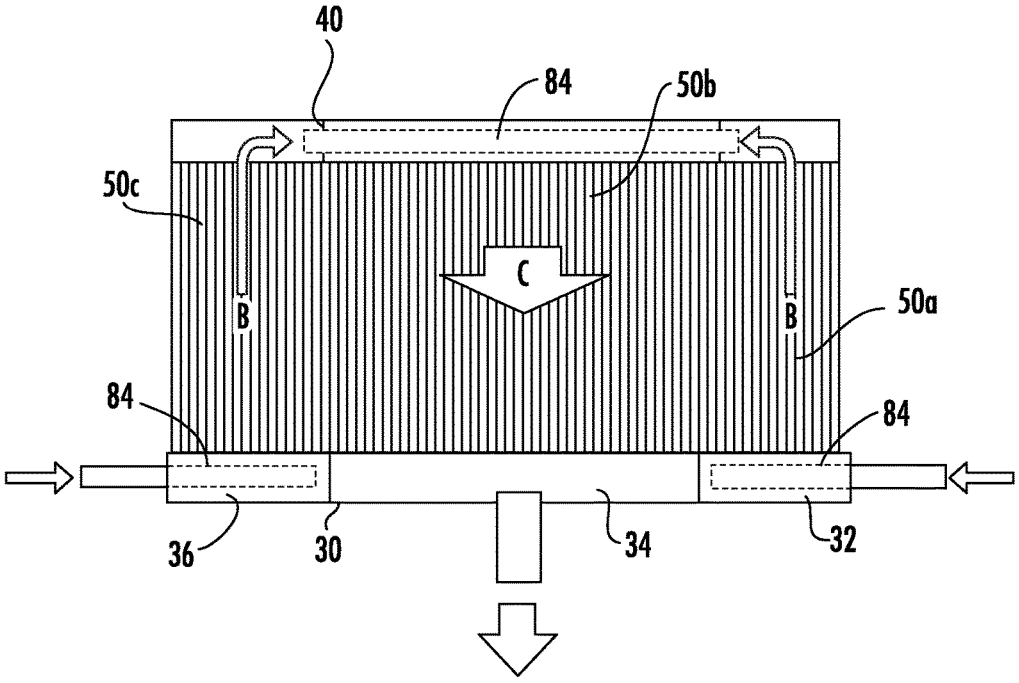
FIG. 10 is a cross-sectional view of a multi-pass microchannel heat exchanger according to an embodiment of the present disclosure.

Referring now to FIGS. 6-10, a longitudinally elongated distributor insert 84, as is known in the art, may be arranged within one or more chambers of the first and second header 30, 40 of the multi-pass multichannel heat exchanger 20. The distributor insert 84 is arranged generally centrally within the interior volume of the header 30, 40 and is configured to evenly distribute the flow of refrigerant between the plurality of heat exchanger tubes 50 fluidly coupled thereto. In one embodiment, particularly when the heat exchanger 20 is configured to operate as an evaporator as shown in each of FIGS. 6-10, a distributor insert 84 is arranged within the first chamber 32 of the first header 30 configured to receive at least a partially liquid refrigerant. The distributor insert 84 arranged within the first chamber 32 of the first header 30 generally extends over the full length of the chamber 32 such that the liquid and vapor refrigerant mixture provided thereto will be more evenly distributed over the length of the first chamber 32, thereby improving the heat transfer of the heat exchanger 20. In the two-pass bent heat exchanger configuration having two inlets, as illustrated in FIG. 10, a distributor insert 84 may be arranged within one or both the first chamber 32 and the third chamber 36 of the first header 30.

Figure 6:
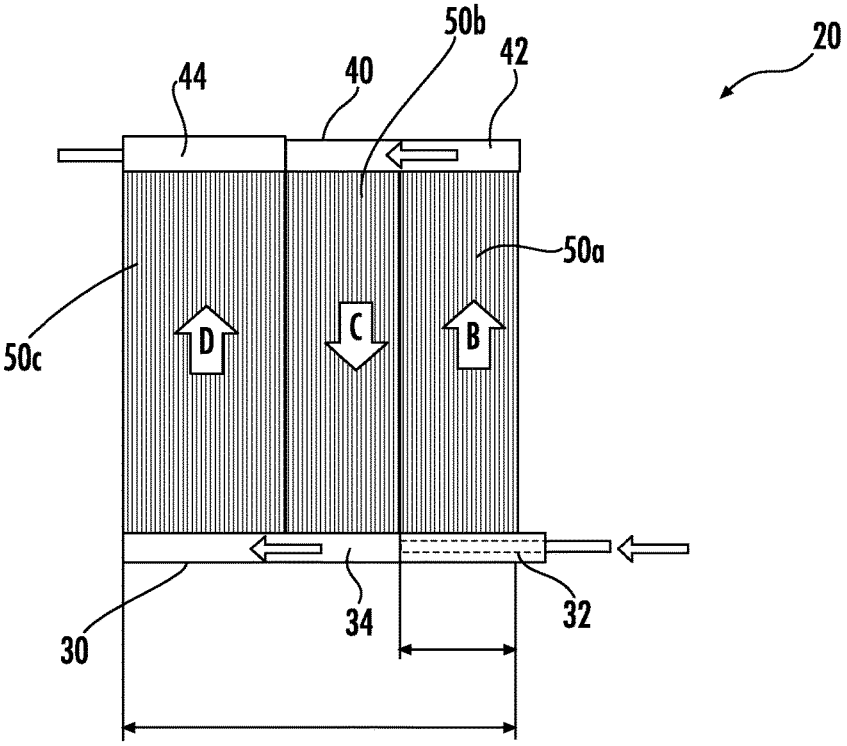
FIG. 6 are various views of a multi-pass microchannel heat exchanger according to an embodiment of the present disclosure.
Figure 7:
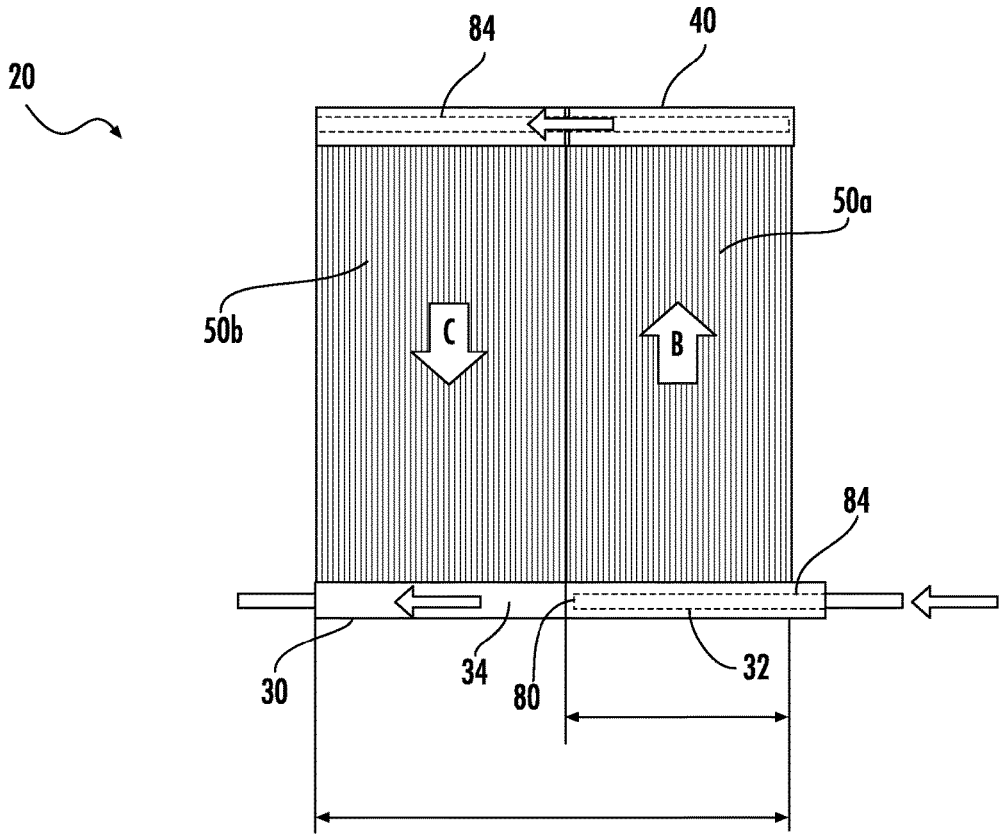
FIG. 7 is a cross-sectional view of a multi-pass microchannel heat exchanger according to an embodiment of the present disclosure.

In other embodiments, as illustrated in FIGS. 6-9, a distributor insert 84 may additionally or alternatively be positioned within an intermediate chamber of one or more headers 30, 40 of the heat exchanger 20. As shown in FIG. 6, ae distributor insert 84 may be arranged within and extend over the entire length of the second header 40. Alternatively, as shown in FIGS. 7-9, the distributor insert 84 may extend over only a portion of the second intermediate header 40 to provide refrigerant to a portion of the heat exchanger tubes 50, such as the second group of heat exchanger tubes 50*b* for example, fluidly coupled thereto. In embodiments, such as FIG. 8, where the heat exchanger 20 has a three-pass configuration, one or both of the intermediate chambers, such as the first chamber 42 of the second header 40, or the second chamber 34 of the first header 30 may include a distributor insert 70. The distributor insert 70 within each of the intermediate chambers may, but need not extend over the full length of the chamber.

Referring now to FIGS. 11-16, when the multi-pass multichannel heat exchanger 20 is employed in a heat pump application, one or more separators 90 may be fluidly coupled to the heat exchanger 20 to improve the efficiency of heat pump. Inclusion of at least one separator 90 may additionally improve the flow distribution through an adjacent portion of the heat exchanger 20 and also provides an accumlator configured to migrate refrigerant when the heat exchanger 20 operates as an evaporator, and less refrigerant is required.

Figure 11:
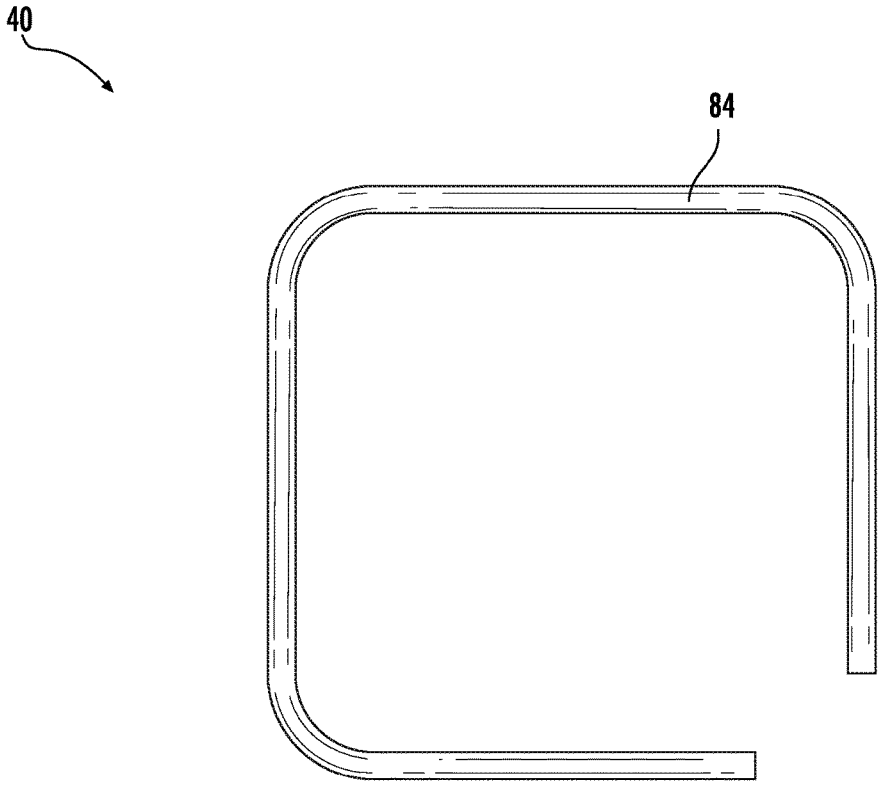
FIG. 11 is a top, cross-sectional view of a header of a multi-pass microchannel heat exchanger according to an embodiment of the present disclosure.

As shown in FIG. 11, a separator 90 fluidly couples a first chamber 42 and a second chamber 44 of the second header 40. Though the heat exchanger 20 illustrated in FIGS. 11-16 has a two-pass configuration, other configurations are within the scope of the present disclosure. When the heat exchanger 20 operates as an evaporator, the vapor and liquid refrigerant mixture provided to the first chamber 42 of the second header 40 via the first group 50*a* of heat exchanger tubes 50 flows into the separator 90. Within the separator 90, gravity causes the vaporized refrigerant and the liquid refrigerant to separate. From the separator 90, the liquid refrigerant is supplied to the second chamber 44 of the second header 40 for further heating, and the vapor refrigerant bypasses the remainder of the heat exchanger 20 via an external conduit 92.

Figure 12:
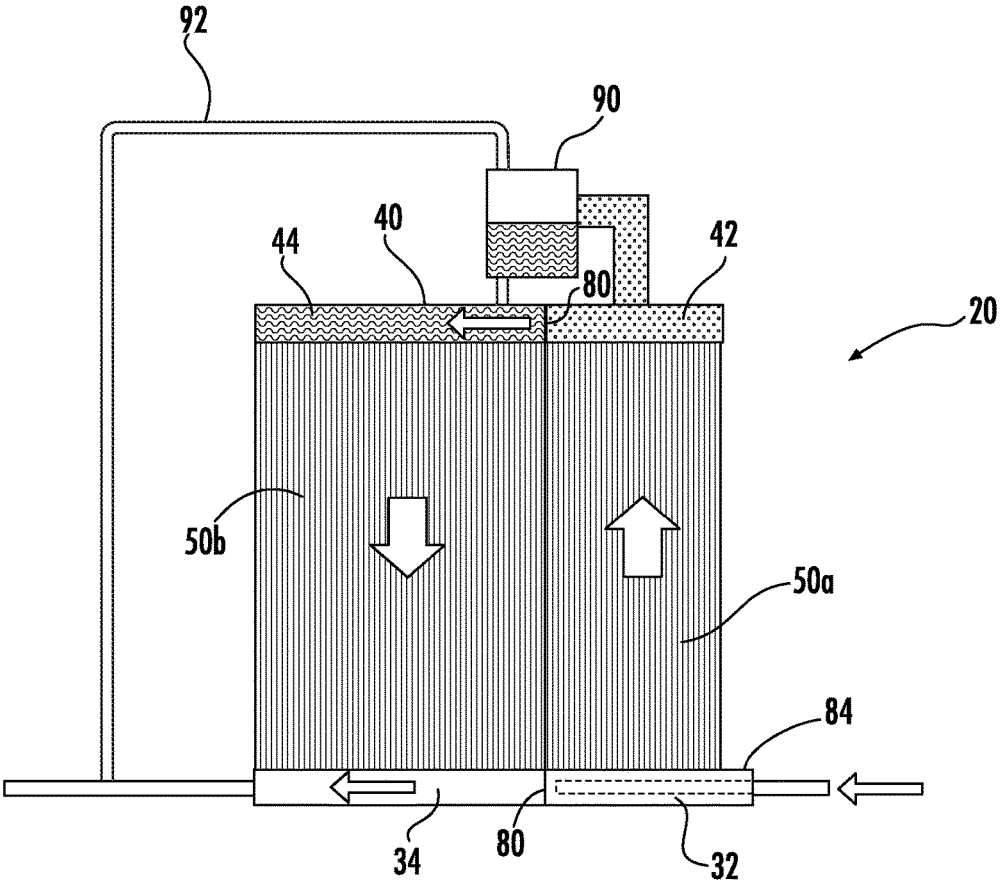
FIG. 12 is a cross-sectional view of a multi-pass microchannel heat exchanger having a first separator according to an embodiment of the present disclosure.

In the embodiment illustrated in FIG. 12, a valve 94 is arranged within the bypass external conduit 92. Although the illustrated valve 94 is a check valve, other valves configured to limit a flow of refrigerant through the bypass conduit 92, such as a solenoid valve for example, are within the scope of the present disclosure. The check valve 94 is configured to allow a flow of refrigerant gas in only one direction through the conduit 92, such that when the heat exchanger 20 is operated as a condenser, all of the refrigerant gas is provided directly to the second chamber 34 of the first header 30. When the heat exchanger 20 is operated as a condenser, all of the refrigerant from the separator 90 is provided to the first chamber 42 of the second header 40 and flows through the first group 50*a* of heat exchanger tubes 50.

Figure 13:
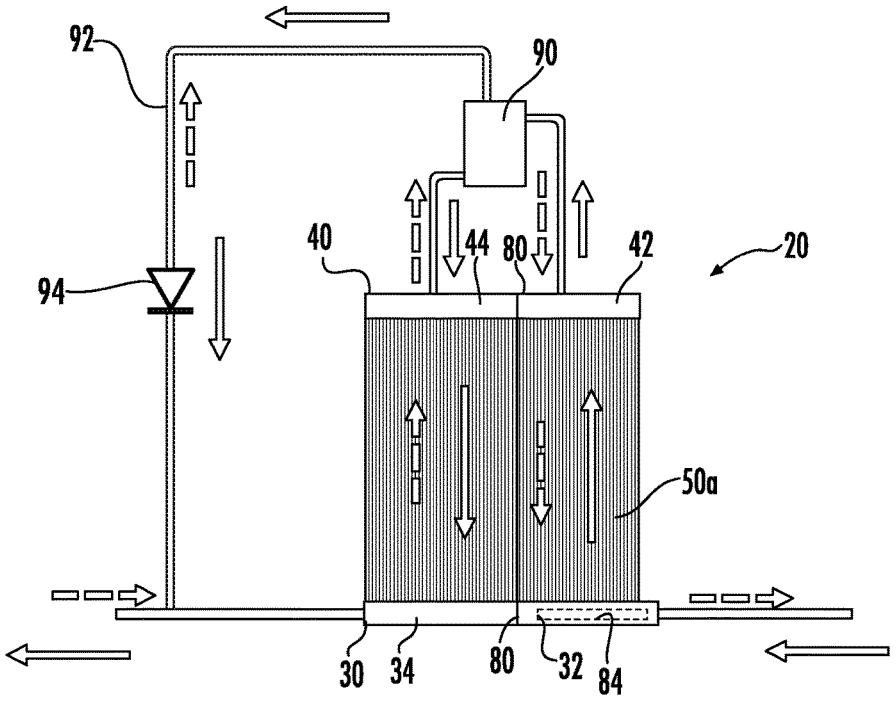
FIG. 13 is a cross-sectional view of another multi-pass microchannel heat exchanger having a first separator according to an embodiment of the present disclosure.

In another embodiment, shown in FIG. 13, another bypass conduit 96 including a check valve 98 extends from the separator and is configured to bypass a flow of refrigerant through the first group 50*a* of heat exchanger tubes 50 when the heat exchanger 20 is operated as a condenser. In such embodiments, the refrigerant provided from the second chamber 44 of the second header 40 to the separator 90 is divided into liquid refrigerant and vapor refrigerant. The vapor refrigerant is provided from the separator 90 to the first chamber 42 of the second header 44 to flow through first group 50*a* of heat exchanger tubes 50 and the liquid refrigerant within the separator 90 is supplied to the bypass conduit 96.

Figure 14:
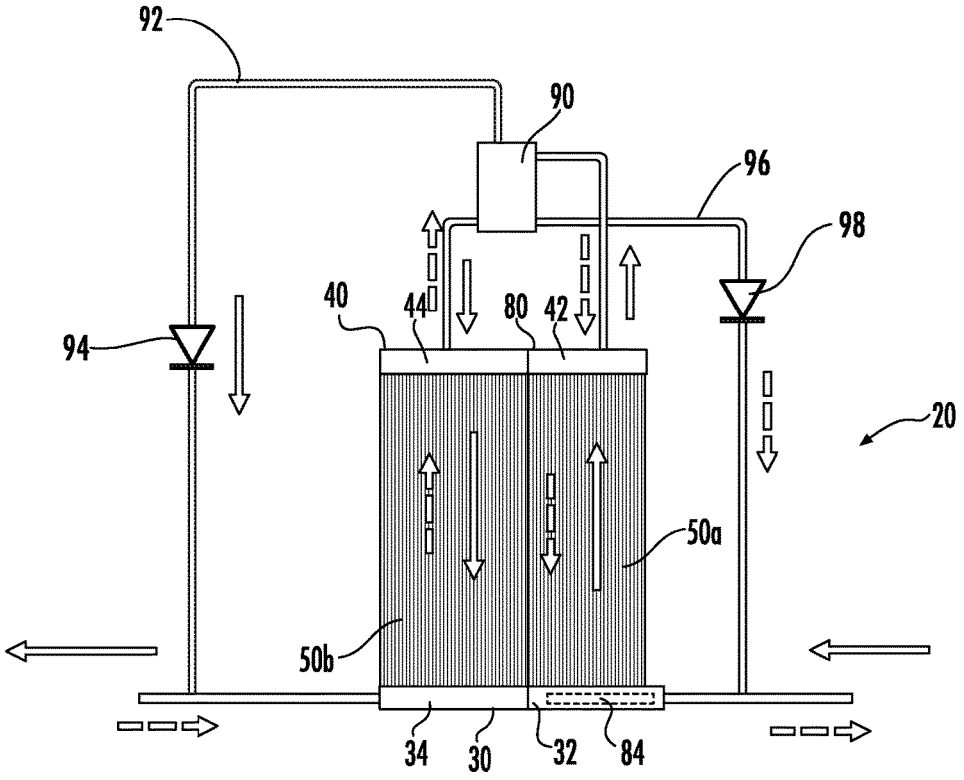
FIG. 14 is a cross-sectional view of another multi-pass microchannel heat exchanger having a first separator according to an embodiment of the present disclosure.

Referring now to FIG. 14, an orifice 100 is arranged in parallel with the check valve 94 of the external conduit 92. When the heat exchanger 20 operates in a condenser mode, a small amount of refrigerant gas is supplied from the bypass conduit 92 to the separator 90 via orifice 96. The remainder of the refrigerant vapor is supplied into the second chamber 34 of the first header 30 of the heat exchanger 20 for flow through a second group 50*b* of heat exchange tubes 50 into the second chamber 44 of the second header 40. The refrigerant flows through a connecting conduit 102 into the first chamber 42 of the first header 40. The refrigerant vapor within the separator 90 is supplied to the first chamber 42 of the second header 40 for flow through the first group 50*a* of heat exchange tubes 50 to the first chamber 32 of the first header 30. A check valve 104 positioned between the separator 90 and the second chamber 44 prevents a flow of vapor refrigerant into the second chamber 44 of the second header 40. If the separator 90 contains a liquid refrigerant when the heat exchanger 20 operates as a condenser, the refrigerant charge of the system may increase. Therefore, providing a small amount of vapor refrigerant to the separator 90 prevents the accumulation of liquid refrigerant in the separator 90.

Figure 15:
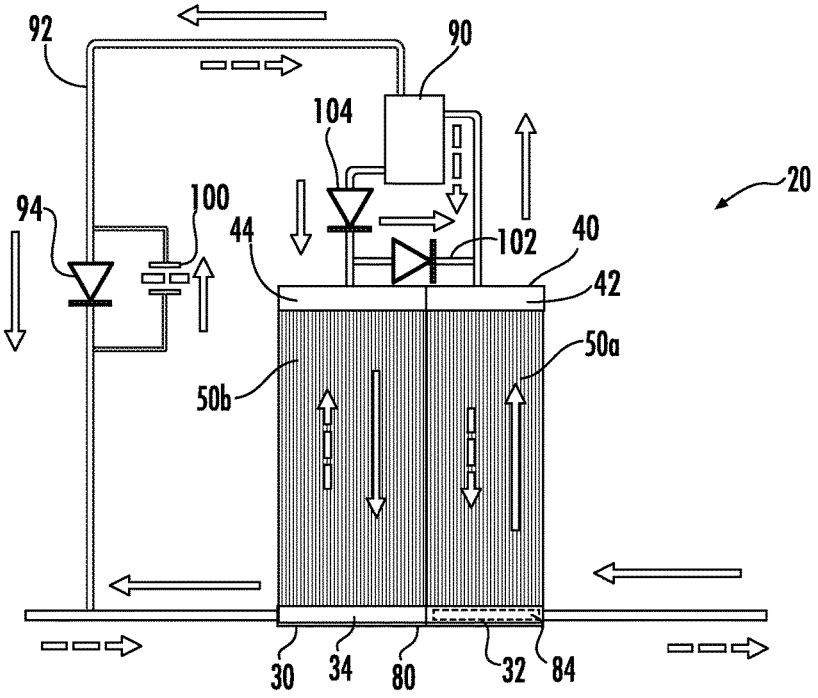
FIG. 15 is a cross-sectional view of another multi-pass microchannel heat exchanger having a first separator according to an embodiment of the present disclosure.
Figure 16:
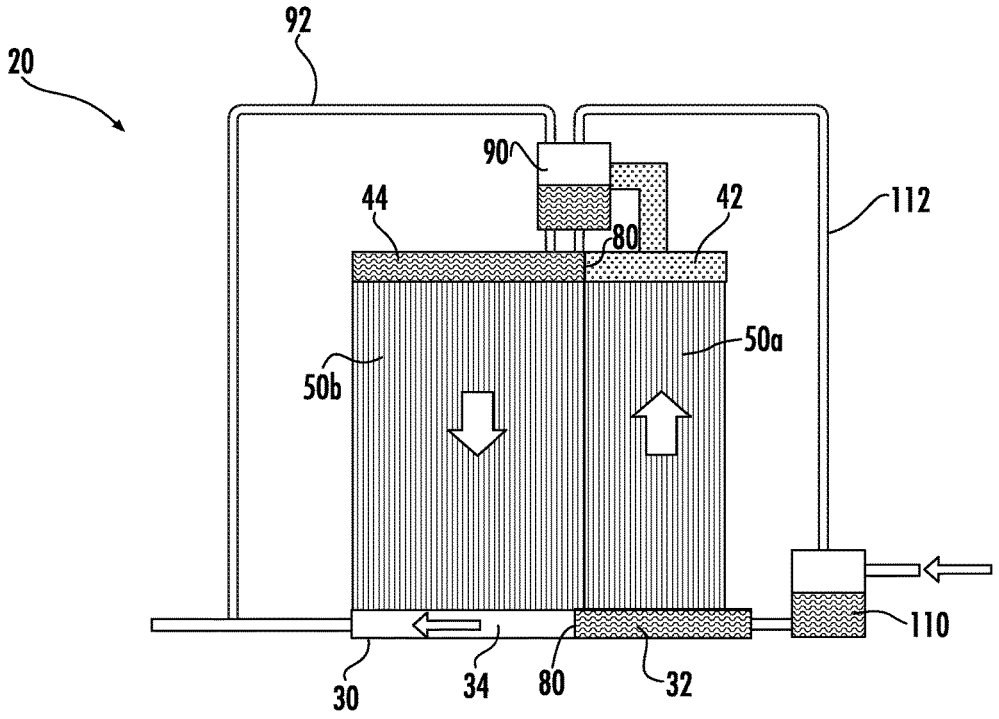
FIG. 16 is a cross-sectional view of a multi-pass microchannel heat exchanger having a plurality of separators according to an embodiment of the present disclosure.
Figure 17:
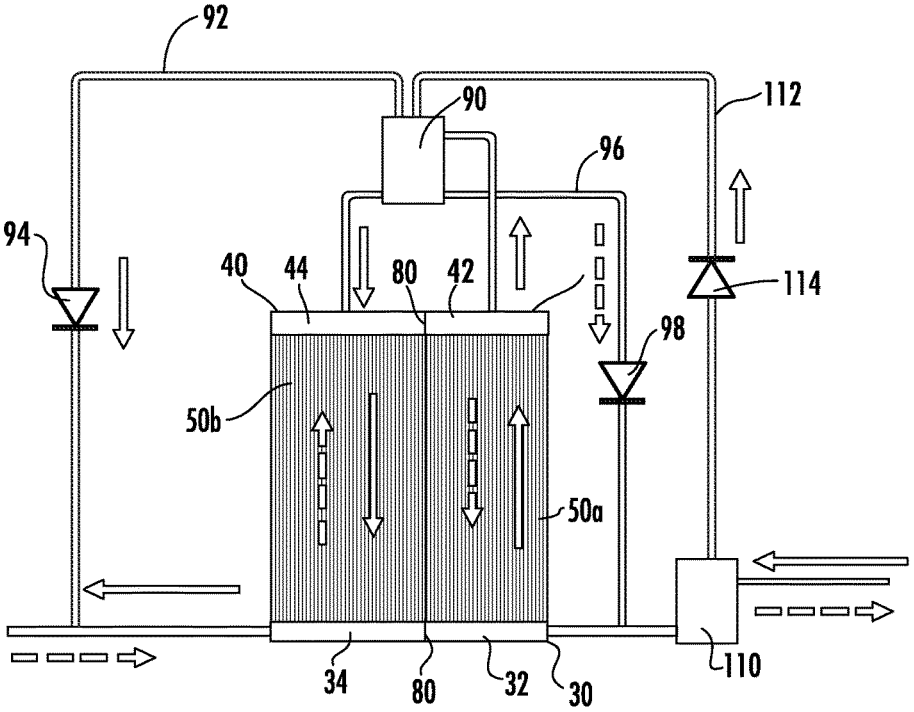
FIG. 17 is a cross-sectional view of a multi-pass microchannel heat exchanger having a plurality of separators according to an embodiment of the present disclosure.

Referring now to FIGS. 15 and 16, a second separator 110 may be arranged adjacent the first chamber 32 of the first header 30 and includes a bypass conduit 112 fluidly coupled to separator 90. When the system of FIG. 16 operates as an evaporator, the liquid portion of the two phase refrigerant provided to the second separator 110 flows to the first chamber 32 of the first header 30 and through the first group 50*a* of heat exchanger tubes 50 to the first chamber 42 of the second header 40 and the separator 90. The vapor portion of the two-phase refrigerant within second separator 110 is provided directly to separator 90 via conduit 112. Within the separator 90, gravity causes the vaporized refrigerant and the liquid refrigerant to separate. From the separator 90, the liquid refrigerant is supplied to the second chamber 44 of the second header 40 for further heating, and the vapor refrigerant bypasses the remainder of the heat exchanger 20 via external conduit 92.

In the embodiment illustrated in FIG. 16, bypass conduit 112 includes a check valve 114 to limit the direction of flow of refrigerant there through. In addition, bypass conduit 96, including check valve 98, extends from the separator 90 and is configured to bypass the first group 50*a* of heat exchanger tubes 50 when the heat exchanger is operated as a condenser. When the heat exchanger 20 operates as an evaporator, liquid refrigerant within the separator 110 will flow to the first chamber 32 of the first header 30 and through the heat exchanger 20 as previously described. Similarly, the vapor refrigerant will flow through bypass conduit 112 to the separator 90 and from the separator 90 into bypass conduit 92. However, when the heat exchanger is operated as a condenser, all of the refrigerant is provided to the second chamber 34 of the first header 30 and flows through the second group 50*b* of heat exchanger tubes 50 into the separator 90. The liquid and vapor refrigerant is separated within the separator 90, such that the vapor refrigerant if provided to the first chamber 42 of the second header and is configured to flow through the first group 50*a* of heat exchange tubes to the first chamber 32 of the first header. The liquid refrigerant from the separator 90 bypasses the second pass of the heat exchanger and is provided adjacent the outlet of the first chamber 32 of the first header 30.

By forming the microchannel heat exchanger with a multi-pass configuration, the length of the portion of the headers 30, 40 configured to receive an at least partially liquid refrigerant, specifically the first chamber 32 of the first manifold 30, and therefore the inner volume of that portion is reduced. The refrigerant charge of the heat exchanger 20 is also reduced as a result of the reduction in inner volume.

While the present disclosure has been particularly shown and described with reference to the exemplary embodiments as illustrated in the drawing, it will be recognized by those skilled in the art that various modifications may be made without departing from the spirit and scope of the present disclosure. Therefore, it is intended that the present disclosure not be limited to the particular embodiment(s) disclosed as, but that the disclosure will include all embodiments falling within the scope of the appended claims. In particular, similar principals and ratios may be extended to the rooftops applications and vertical package units.

We claim:

1. A heat exchanger comprising:

a first manifold;

a second manifold separated from the first manifold;

a plurality of heat exchange tubes arranged in spaced parallel relationship and fluidly coupling the first manifold and the second manifold;

at least one divider plate arranged within the first manifold such that the first manifold has a fluidly distinct first chamber and second chamber and the heat exchanger has a flow configuration including at least a first pass and a second pass, wherein the first chamber is configured to receive at least a partially liquid refrigerant;

a first separator configured to separate a liquid refrigerant and a vapor refrigerant, the first separator being fluidly coupled to the second manifold of the heat exchanger between the first pass and the second pass;

a first bypass conduit extending from the first separator and configured to bypass the second pass of the heat exchanger, the first bypass conduit including a valve located separate from the first separator, the valve being operable to limit a flow through the bypass conduit in a first direction;

a second separator configured to separate an incoming liquid refrigerant and an incoming vapor refrigerant, the second separator being arranged in direct fluid communication with the first separator and the first chamber of the first manifold of the heat exchanger; and a second bypass conduit fluidly coupling the second separator to the first separator to bypass the first pass of the heat exchanger.

2. The heat exchanger according to claim 1, wherein the heat exchanger is configured to operate as an evaporator in a heat pump system.

3. The heat exchanger according to claim 1, wherein the heat exchanger is configured to operate as a condenser in a heat pump system.

4. The heat exchanger according to claim 1, wherein the first chamber of the first manifold has an inner volume, and a first distributor insert is arranged within the inner volume.

5. The heat exchanger according to claim 4, further comprising a second distributor insert arranged within at least one of the second manifold and the second chamber of the first manifold.

6. The heat exchanger according to claim 1, wherein the first chamber has a length between about 20% and about 60% a length of the first manifold.

7. The heat exchanger according to claim 6, wherein the length of the first chamber is between about 30% and about 50% of the length of the first manifold.

* * * * *